US008991512B2

(12) United States Patent
George et al.

(10) Patent No.: US 8,991,512 B2
(45) Date of Patent: Mar. 31, 2015

(54) DEVICE FOR IMPROVED CLEAN UP OF HOLES, AND METHOD OF USING SAME

(71) Applicants: Nicholas A. George, Peotone, IL (US); Eric A. Gore, Bradley, IL (US)

(72) Inventors: Nicholas A. George, Peotone, IL (US); Eric A. Gore, Bradley, IL (US)

( * ) Notice: Subject to any disclaimer, the term of this patent is extended or adjusted under 35 U.S.C. 154(b) by 58 days.

(21) Appl. No.: 13/928,044

(22) Filed: Jun. 26, 2013

(65) Prior Publication Data

US 2015/0000981 A1 Jan. 1, 2015

(51) Int. Cl.
*A01B 13/00* (2006.01)
*E21B 21/015* (2006.01)

(52) U.S. Cl.
CPC ..... *E21B 21/015* (2013.01)
USPC ..... 172/25

(58) Field of Classification Search
USPC ..... 56/1, 328.1, 329; 294/1.1, 137, 59, 294/50.5; 37/411, 420, 466, 434; 172/25
See application file for complete search history.

(56) References Cited

U.S. PATENT DOCUMENTS

| | | | | | |
|---|---|---|---|---|---|
| 4,058,956 | A | * | 11/1977 | Skonieczny | 56/1 |
| 4,204,577 | A | * | 5/1980 | Bittle | 172/25 |
| 5,088,751 | A | | 2/1992 | Zint | |
| D380,127 | S | * | 6/1997 | Feigh et al. | D8/1 |
| D419,042 | S | * | 1/2000 | Price | D8/1 |
| RE36,775 | E | * | 7/2000 | Hoheisel | 428/66.1 |
| 6,315,310 | B1 | | 11/2001 | Hurt | |
| D562,647 | S | * | 2/2008 | Baars | D8/1 |
| 2003/0097772 | A1 | | 5/2003 | Christensen | |

* cited by examiner

*Primary Examiner* — Robert Pezzuto
(74) *Attorney, Agent, or Firm* — McDonnell Boehnen Hulbert & Berghoff LLP

(57) ABSTRACT

A cleanup device having a first board having a first edge, a second board having a first edge, a first hinge attached to the first edge of the first board and the first edge of the second board, an aperture defined by a portion of the first edge of the first board and a portion of the first edge of the second board, a first plate slidably attached to the first board, wherein the first plate is movable from a first, open position where the aperture is open to a second, closed position where the first plate extends over at least a portion of the aperture, and wherein a top surface of the first board is movable towards a top surface of the second board to form a V-shaped surface for directing dirt or soil off of the first board and the second board.

20 Claims, 7 Drawing Sheets

DEVICE FOR IMPROVED CLEAN UP OF HOLES, AND METHOD OF USING SAME

BACKGROUND

The present application generally relates to devices for cleaning up dirt and soil resulting from boring or digging a hole in the earth, when using an auger or other digging tool such as a clamshell digger. More particularly, the present application relates to a device that may be used to collect and remove the dirt and soil displaced when boring or digging a hole for a post, such as a fence post or post for a deck.

Professional tradesmen, carpenters, and others are often called upon to build fences or decks. Posts are typically positioned at intervals to support the fences or decks. The bottom of the posts are positioned in holes that are bored or dug into the earth, and once the post is positioned within the hole, some of the dirt or soil may be filled in around the post or the post may be set in concrete, as examples.

The holes may be bored into the ground using a power auger. Alternatively, the holes may be bored or dug using handheld tools such as a shovel, spade, hand auger or a clamshell digger, or some combination thereof. Regardless of how the hole is created, the hole is formed by removing dirt and soil (or sand or gravel) from the earth, which becomes piled up around the hole. During the course of boring or digging the holes and positioning posts within the holes, the dirt and soil piled around the holes may also get stepped on and tracked around the yard. Eventually, after the posts are positioned within the holes, the dirt and soil piled up around the posts, and the dirt and soil tracked around the yard needs to be cleaned up and removed.

The process of cleaning and removing the dirt and soil around each post, and the dirt and soil tracked around the yard, may be a time-consuming and tedious process. It may take two workers 20 to 30 minutes per post to properly clean up the area around each post. The cleanup process may involve shoveling the dirt and soil piled up around the posts and moving it into a wheelbarrow or cart where it may be removed from the area. The cleanup process may also entail using a shop vacuum and/or hosing down the grass to return the yard to a pristine condition. A typical fence may have 30 to 50 posts. Therefore, there is a significant amount of time and expense involved in cleaning up the dirt and soil removed from the holes.

As a result of the labor-intensive and time-consuming cleanup process, it would be desirable to provide a device that can be used to more easily collect and remove the dirt and soil displaced from the holes. It would also be desirable to provide a tool that may be used that results in a reduction of time required to clean up the dirt and soil displaced from the holes during the hole forming process.

SUMMARY

In one aspect, a device for the cleanup of dirt or soil removed when forming a hole in the earth is provided having a first board having a first edge, a second board having a first edge, a first hinge attached to the first edge of the first board and the first edge of the second board, an aperture defined by a portion of the first edge of the first board and a portion of the first edge of the second board, a first plate slidably attached to the first board, wherein the first plate is movable from a first, open position where the aperture is open, to a second, closed position where the first plate extends over at least a portion of the aperture, and wherein a top surface of the first board is movable towards a top surface of the second board to form a V-shaped surface for directing dirt or soil off of the first board and the second board.

In a further aspect, a device for the cleanup of dirt or soil removed when forming a hole in the earth is provided having a board having a top surface and a bottom surface, an aperture positioned through the board, a plate slidably attached to the board, wherein the plate is movable from a first, open position where the aperture is open, to a second, closed position where the plate extends over the aperture, and wherein the aperture has a diameter that is sized to accommodate an 8-inch auger positioned through the aperture when a hole is being drilled by the auger.

In a further aspect, a method is provided having the steps of positioning a board having a top surface and a bottom surface over an area where a hole is to be formed in the earth, positioning an aperture located on the board over a spot where the hole is to be formed, positioning a plate slidably attached to the board into a first, open position where the aperture is open, forming a hole in the spot, collecting dirt or soil removed when forming the hole on the top surface of the board, moving the plate to a second, closed position, where the aperture is closed, transporting the board to a place where the dirt or soil may be directed off of the board, and tilting the board to direct dirt or soil that was collected on the board off of the board.

BRIEF DESCRIPTION OF THE DRAWINGS

Exemplary embodiments of the invention are described herein with reference to the drawings, wherein like parts are designated by like reference numerals, and wherein.

DETAILED DESCRIPTION

Figure 1:
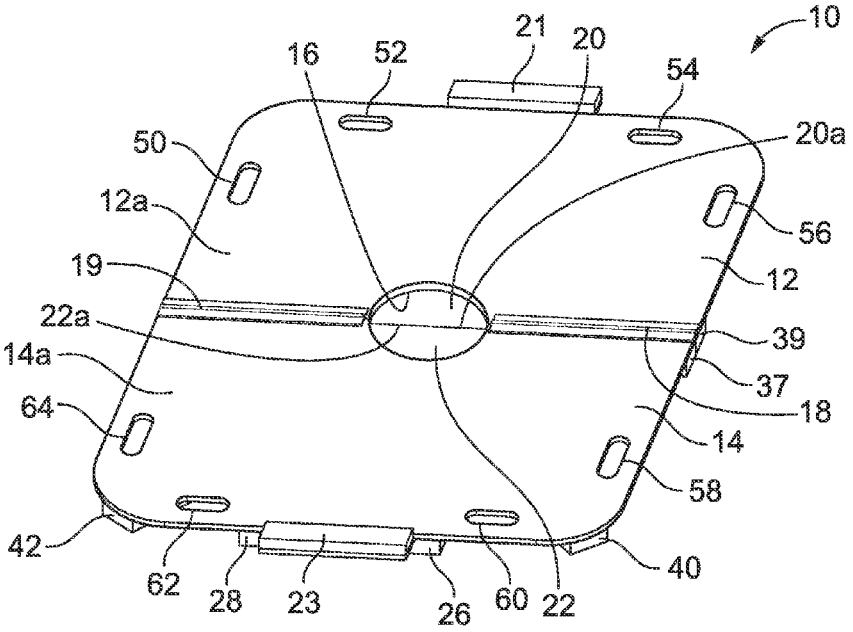
FIG. 1 is a perspective top view of cleanup device 10 with first plate 20 and second plate 22 in a second, closed position with respect to aperture 16.

FIG. 1 is a perspective top view of cleanup device 10 having a first board 12 attached to a second board 14 with hinge 18 and hinge 19. An aperture 16 is defined by a portion of first board 12 and a portion of second board 14, and is positioned between hinge 18 and hinge 19. In FIG. 1, a first plate 20 is shown in a closed position with respect to aperture 16, and second plate 22 is also shown in a closed position with respect to aperture 16. First board 12 includes a number of holes 50, 52, 54, and 56 that may serve as handholds for a user to hold onto when moving or transporting the cleanup device 10, or tilting the device when directing dirt or soil off of the boards. Similarly, second board 14 also includes a number of holes 58, 60, 62, and 64 that may also serve as handholds for a user to hold onto when moving or transporting the cleanup device 10, or tilting the device when directing dirt or soil off of the boards.

Figure 2:
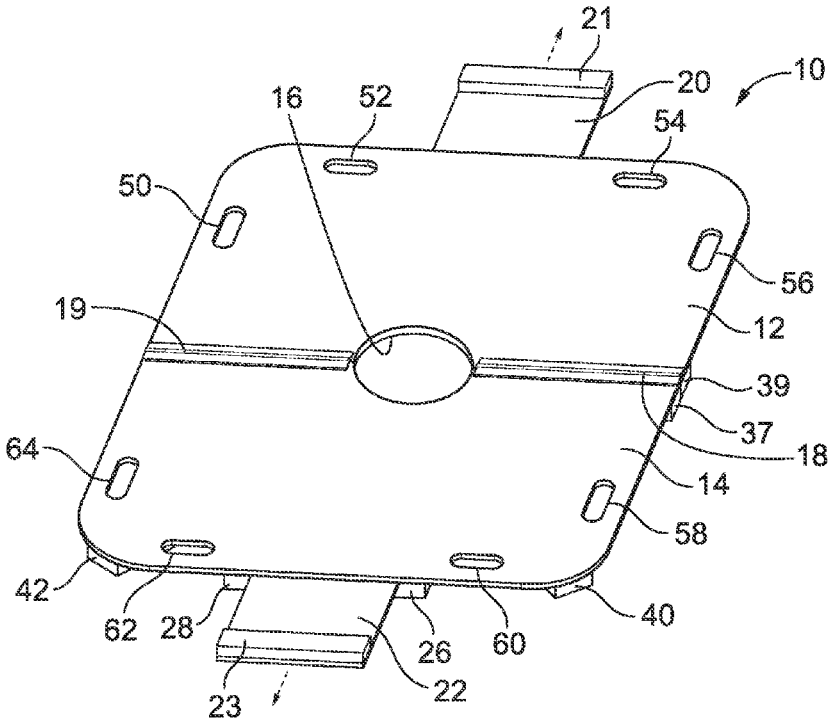
FIG. 2 is a perspective top view of the cleanup device 10 shown in FIG. 1, with first plate 20 and second plate 22 in a first, open position with respect to aperture 16.

FIG. 2 is a perspective top view of the cleanup device 10 shown in FIG. 1, with first plate 20 and second plate 22 in an open position with respect to aperture 16. Plate handle 21 may be used to pull plate 20 away from the aperture 16 to open aperture 16 and plate handle 23 may be used to pull plate 22 away from the aperture 16 to open aperture 16. When it is desired to move plates 20 and 22 back into a closed position, then plate handles 21 and 23 may be used to push the plates 20 and 22 back to a closed position shown in FIG. 1, where the aperture 16 is substantially closed. Plate 22 is shown have slidable movement between plate holders 26 and 28 and the bottom surface of board 14.

As shown in FIG. 1, an edge 20*a* of plate 20 is engaged with an edge 22*a* of plate 22 when the plates are in the closed position. It will be recognized that gaps could exist at the interface between edge 20*a* and edge 22*a* when the aperture is substantially closed. Therefore, as used herein, the term "substantially closed" means that the area of the aperture is at least 90% blocked by plate 20 and/or plate 22. Furthermore, while not shown in FIG. 1, one of the ends 20*a* or 22*a* could extend beyond the other of the ends 20*a* or 22*a* when the plates 20 and 22 are in the closed position.

Moreover, in some embodiments, only a single plate may be required. For example, a plate having a flexible end could be used to cover the aperture and bend when the board 12 and board 14 are moved into a V-shaped surface, while still covering the aperture 16. In addition, while plates 20 and 22 are shown positioned on the bottom of boards 12 and 14, it is also possible that plates 20 and 22 could be positioned on the top surface of boards 12 and 14.

Figure 3:
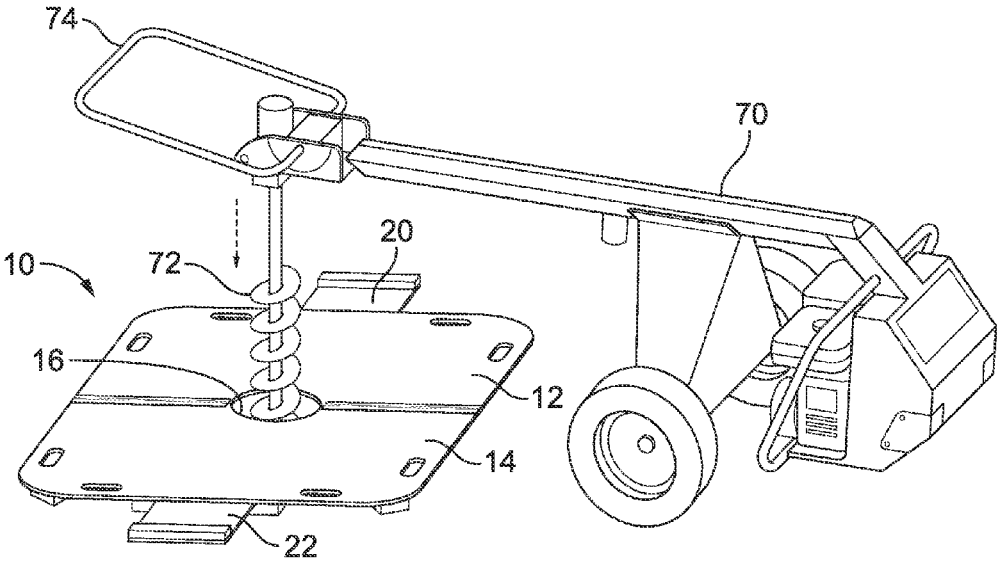
FIG. 3 is a perspective top view of the cleanup device 10 shown in FIGS. 1 and 2 with auger 72 positioned through aperture 16.

FIG. 3 is a perspective top view of the cleanup device 10 shown in FIGS. 1 and 2. In FIG. 3, a power auger 70 that may be used to bore holes for fence or deck posts is shown. A handle 74 is shown which may be used to position auger 72 through aperture 16 of cleanup device 10 and over a spot where it is desired to bore a hole. At this stage of the process the plates 20 and 22 are in the open position, before the hole has been bored.

Figure 4:
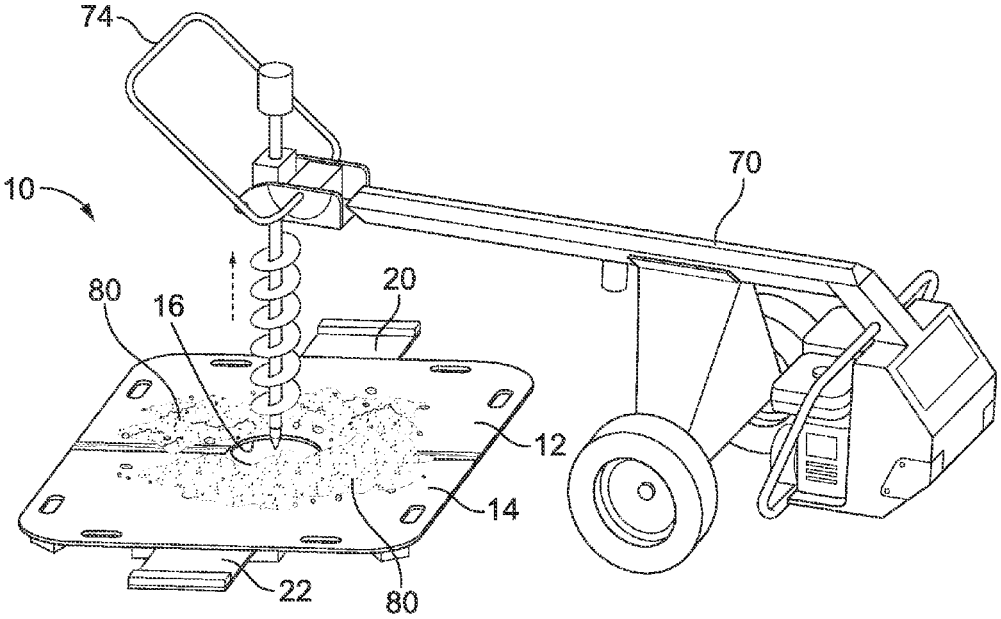
FIG. 4 is a perspective top view of cleanup device 10 shown in FIGS. 1-3 after a hole is been formed with dirt or soil 80 collected on cleanup device 10.

FIG. 4 is a perspective view showing the cleanup device 10 after a hole has been bored by the power auger 70 shown in FIG. 3. Typical holes may be bored 42 inches deep. As the hole is bored, dirt and soil are displaced from the hole and collected into piles 80 on top of board 12 and board 14. In this manner, the cleanup tool 10 may be used to collect the dirt and soil removed by the auger and prevent it from accumulating in piles directly on the grass surrounding the hole. In addition, if using handheld tools such as a clamshell digger, the dirt or soil displaced by such tools may also be collected and piled onto the top of board 12 and 14.

Figure 12:
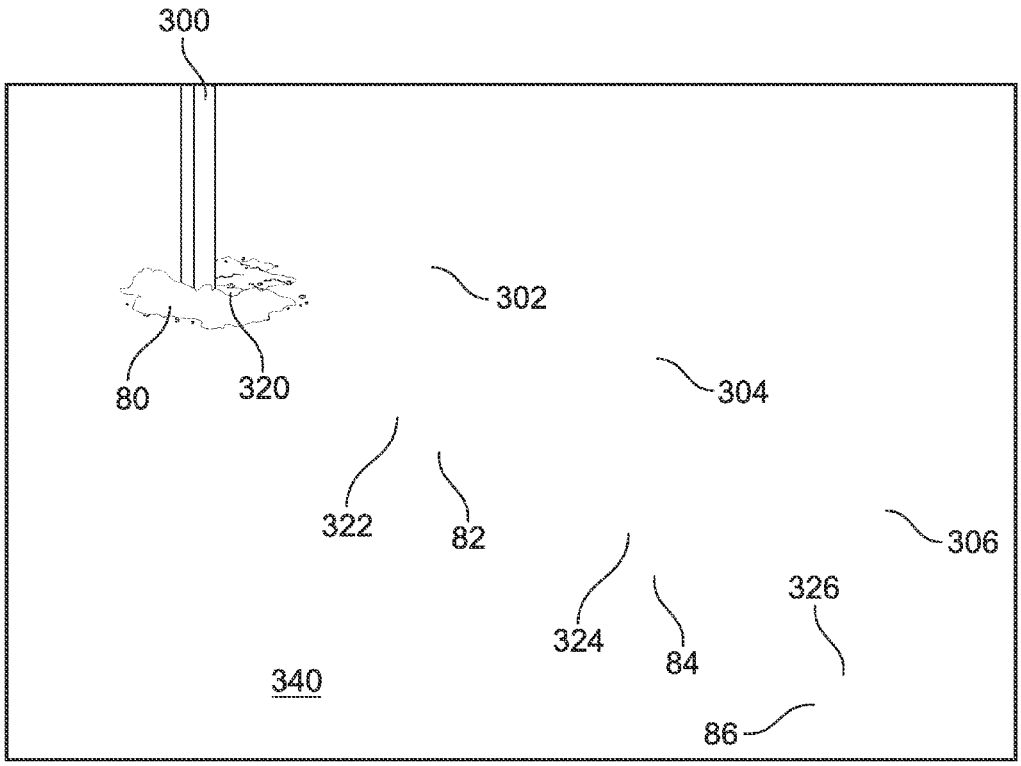
FIG. 12 is a perspective view of a series of posts after being positioned within holes formed in the earth, showing piles of dirt and soil surrounding the posts.

In the absence of using cleanup tool 10, after positioning the posts within the holes, each post would be surrounded by a pile of dirt or soil displaced from hole during the formation of the hole. In particular, FIG. 12 is a perspective view of a series of posts after being positioned within holes formed in the earth of yard 340 without the use of cleanup tool 10, showing piles of dirt and soil surrounding the posts. In particular, post 300 is shown positioned within hole 320 and surrounded by a pile of dirt and soil 80, post 302 is shown positioned within hole 322 and surrounded by a pile of dirt and soil 82, post 304 is shown positioned within hole 324 and surrounded by a pile of dirt and soil 84, and post 306 is shown positioned within hole 326 and surrounded by a pile of dirt and soil 80. Such piles are eliminated, or significantly reduced, when using cleanup 10 during the hole forming process.

Typical fence or deck posts may be 4 inches by 4 inches, in which case auger 72 may have an 8-inch diameter bit, while other fence and deck posts may be 5 inches by 5 inches, in which case auger 72 may have a 10-inch diameter bit. Therefore, the diameter of aperture 16 should be sized to accommodate at least an 8-inch bit. However, to accommodate both an 8-inch diameter bit and a 10-inch diameter bit, the diameter of aperture 16 should be 12 inches or more. However, the larger the diameter of the aperture, the more dirt and soil will drop back onto the area surrounding the hole, instead of onto boards 12 and 14 as is desired. Therefore, it has been found that an aperture with a diameter of 12 inches provides sufficient flexibility to accommodate an 8-inch bit and a 10-inch bit without allowing too much dirt or soil to fall through the aperture 16. It will be appreciated that while aperture 16 is shown as a circular hole, other geometries for the aperture which may not be as advantageous as a circular hole could be used as well. In addition, the cleanup device 10 may also be used for other larger applications. For example, a telephone pole may require a 16 inch diameter hole, and the aperture 16 of cleanup device 10 may be sized to accommodate a hole of that size, or larger, as well.

Figure 5:
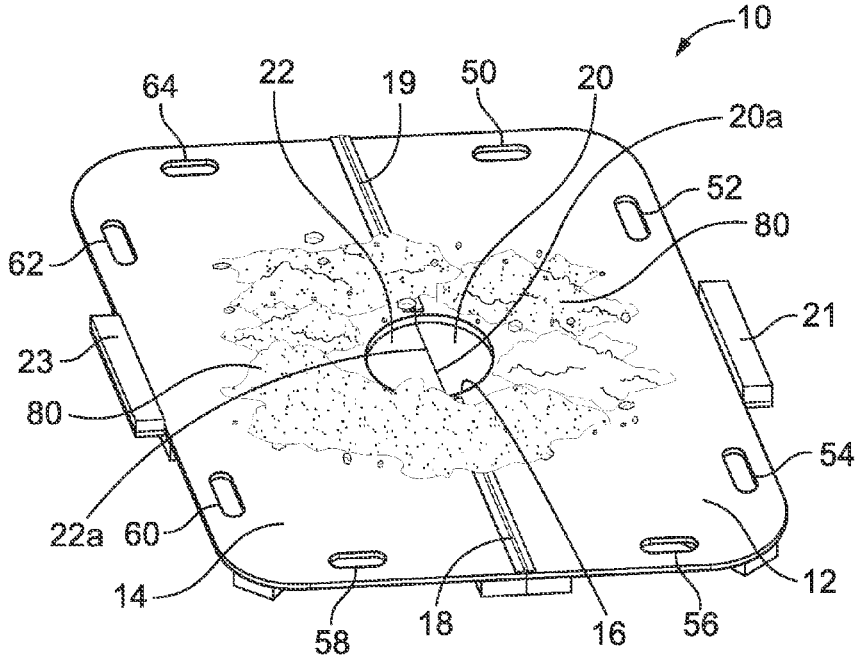
FIG. 5 is a perspective top view of cleanup device 10 shown in FIGS. 1-4 with first plate 20 and second plate 22 moved back to the second, closed position with respect to aperture 16 shown in FIG. 1.

FIG. 5 is a perspective top view of cleanup device 10 shown in FIGS. 1-4 after the auger has been removed. Piles of dirt or soil 80 are shown collected about aperture 16. Once the hole is completed and the auger or handheld tool such as a clamshell digger are removed, first plate 20 and second plate 22 are shown moved back to the second, closed position with respect to aperture 16. The cleanup tool is now ready to remove the piles of dirt and soil 80 collected on top of boards 12 and 14 from the hole site.

Figure 6:
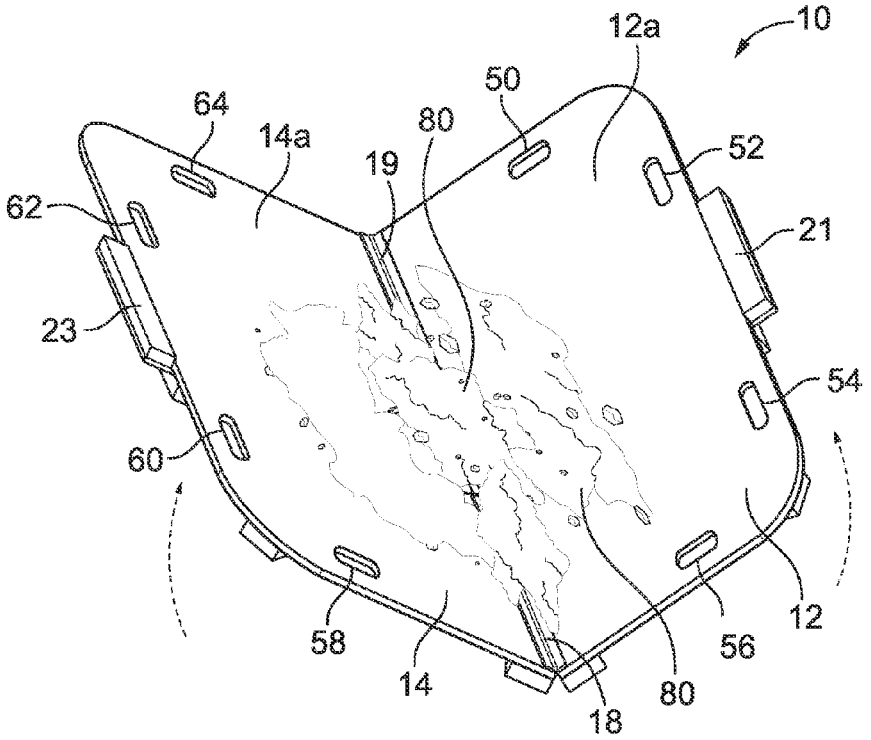
FIG. 6 is a perspective top view of the cleanup device shown in FIG. 5, with the top surface 12*a* of first board 12 moved towards the top surface 14*a* of second board 14 to form a V-shaped surface for directing the dirt or soil 80 off of the cleanup device 10.

FIG. 6 is a perspective top view of the cleanup device shown in FIG. 5, with the top surface 12*a* of first board 12 moved towards the top surface 14*a* of second board 14 to form a V-shaped surface for directing the dirt or soil 80 off of the cleanup device 10. In this example, hinges 18 and 19 are used to attach board 12 to board 14 and allow the boards to move to form a V-shaped surface. As used herein, the term "hinge" is to be interpreted broadly to include any device that can be used to attach an end of board 12 to an end of board 14 and allow upper surfaces 12*a* and 14*a* of boards 12 and 14 to move towards each and form a V-shaped surface.

It will be appreciated that hinges 18 and 19 may be used to allow the upper surface 12*a* and 14*a* of boards 12 and 14 to be drawn together into contact with each other, thereby enabling the cleanup device 10 to be folded which provides for more convenient transportation and storage of cleanup device 10.

Figure 7:
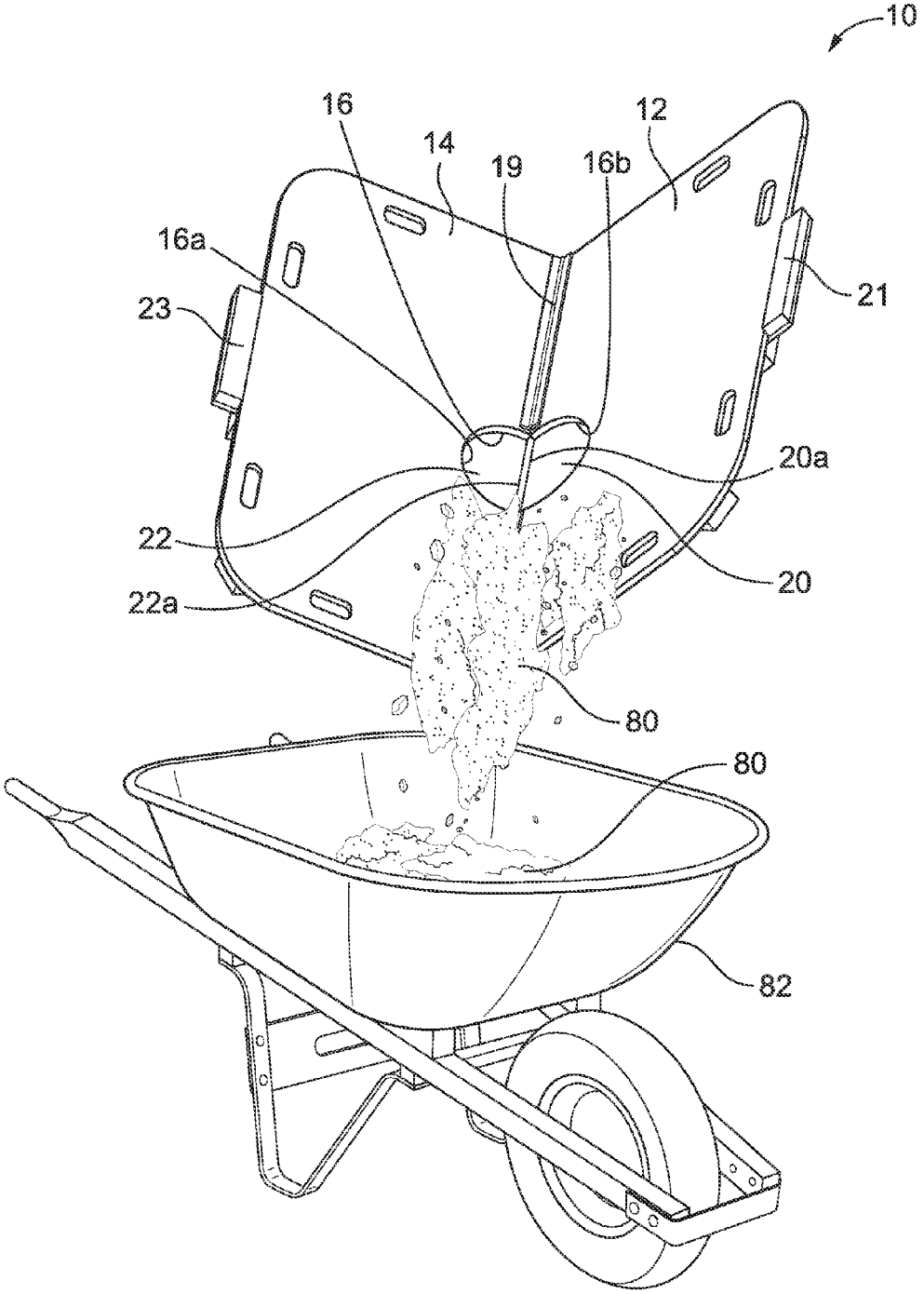
FIG. 7 is a perspective top view of the cleanup device 10 shown in FIG. 6 with the dirt or soil 80 being directed off of cleanup device 10.

FIG. 7 is a perspective top view of the cleanup device 10 shown in FIG. 6 with the dirt or soil 80 being directed off of cleanup device 10 with boards 12 and 14 formed into a V-shape surface. It will be noted that the ends 20*a* and 22*b* of plates 20 and 22 remain in the closed position during this step of the process where the aperture remains in a substantially closed position. In this step of the process, the piles of dirt or soil 80 are directed into wheelbarrow 82, where it may be further removed from the hole site.

Figure 8:
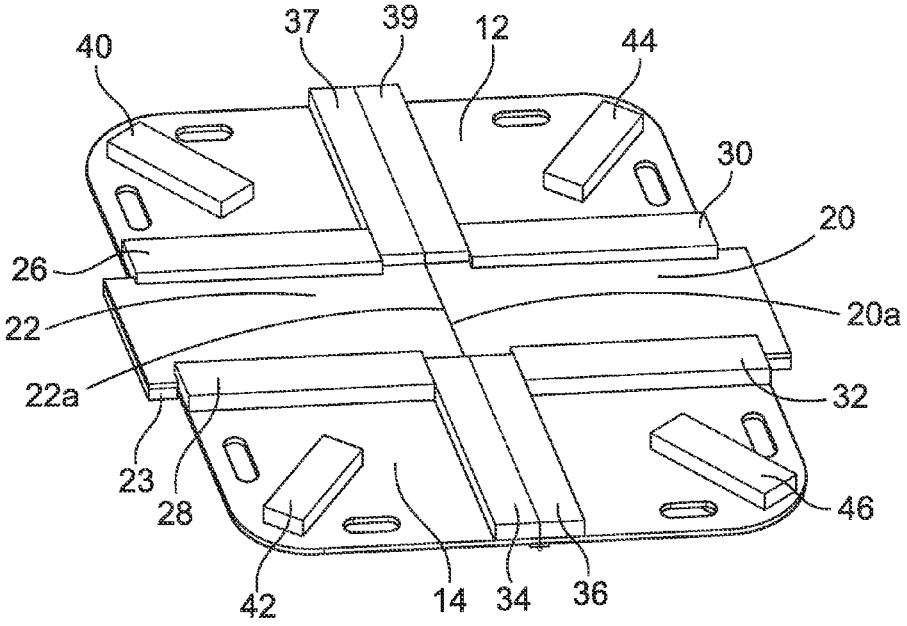
FIG. 8 is a perspective bottom view of the cleanup device 10 shown in FIGS. 1-7 with first plate 20 and second plate 22 in a second, closed position with respect to aperture 16.

FIG. 8 is a perspective bottom view of the cleanup device 10 shown in FIGS. 1-7 with first plate 20 and second plate 22 in a closed position with respect to aperture 16. Plate 20 is adapted for slidable linear movement between plate holders 30 and 32 and the bottom of board 12. Similarly, plate 22 is adapted for slidable linear movement between plate holders 26 and 28 and the bottom of board 14. Supports 37, 39, 34, and 36 are also positioned on the bottom of boards 12 or 14, and supports 40, 42, 44, and 46 are also positioned on the bottom of boards 12 or 14 to provide support for someone standing on cleanup tool 10 during the hole forming process. While the supports are shown as separate members attached the boards 12 or 14, this represents only an example configuration. It will be appreciated that the supports could be formed to together as a single unit, formed integrally with the board 12 or 14, and/or have different geometries.

Figure 9:
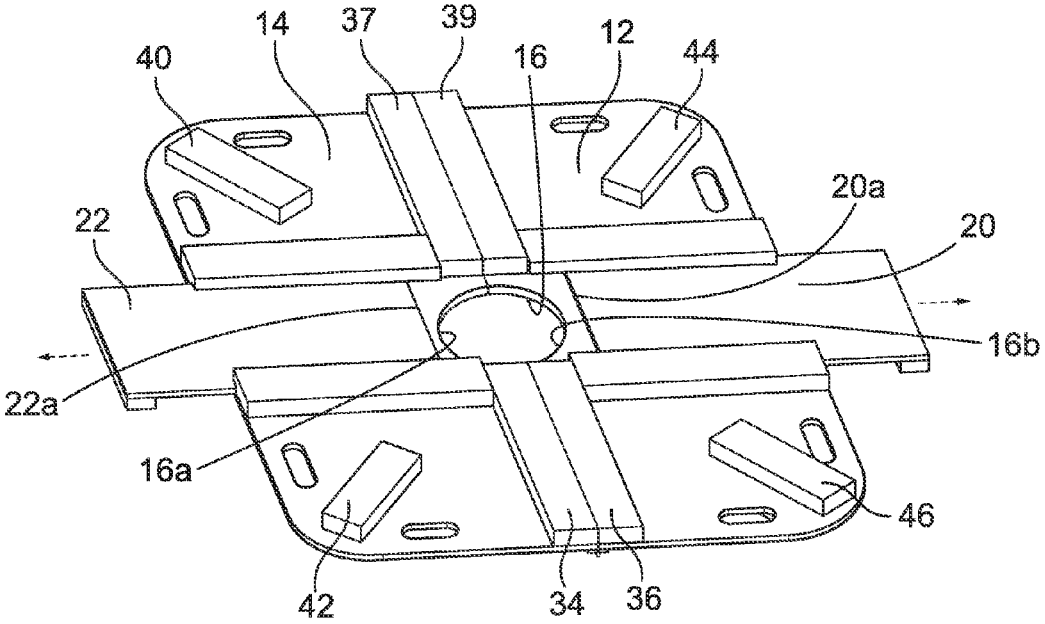
FIG. 9 is a perspective bottom view of the cleanup device 10 shown in FIGS. 1-8 with first plate 20 and second plate 22 in a first, open position with respect to aperture 16.

FIG. 9 is a perspective bottom view of the cleanup device 10 shown in FIGS. 1-8 with first plate 20 and second plate 22 in an open position with respect to aperture 16. Here the plates 20 and 22 have been pulled away from aperture 16 with a linear movement. However, it is also possible that the aperture could be opened or closed using a plate that is moved using rotational movement. For example, a plate could be rotated 90 degrees to move a plate over the aperture 16, and rotated back 90 degrees to move the plate away from aperture 16.

Figure 10:
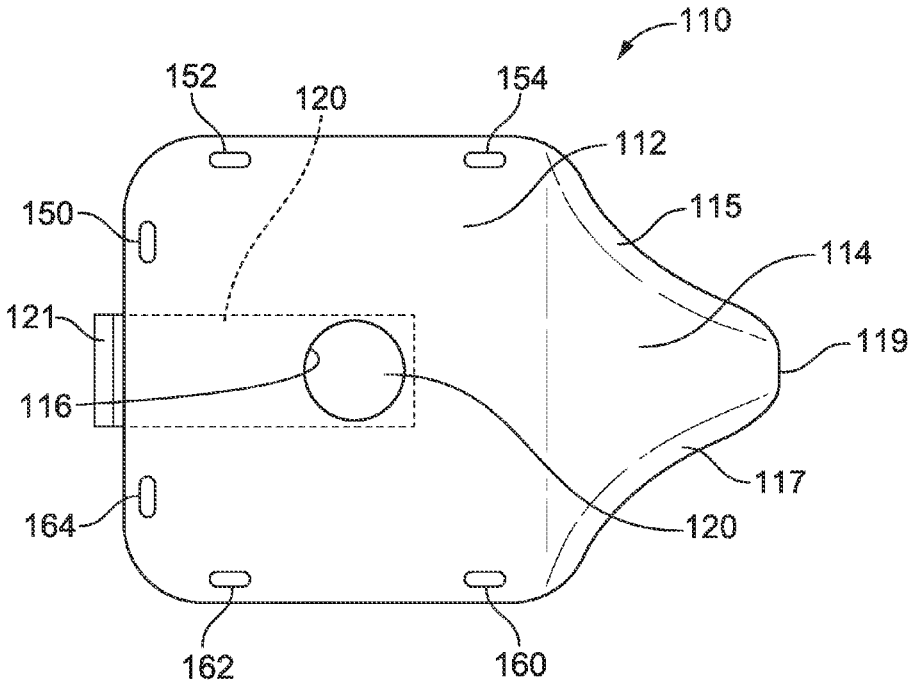
FIG. 10 is a top view of cleanup device 110 having a chute extending from an end thereof.

FIG. 10 is a top view of cleanup tool 110 having a chute 114 extending from an end thereof. The chute 114 may be a separate element attached to the board 112 or integrally formed with board 112. Cleanup tool 110 is similar to the cleanup tool 10 shown in FIGS. 1-9 with aperture 116 the same as aperture 16, and a plate 120 that is movable from a first closed position as shown in FIG. 10 to a second open position where the aperture 116 is open. Plate handle 121 may be used to move the plate 120 as desired. Cleanup tool 110 includes board 112 having aperture 116 extending through board 112, and holes 150, 152, 154, 160, 162, and 164 that may serve as handholds for manipulating and transporting cleanup tool 110.

Cleanup tool 110 further includes chute 114 that has a chute wall 115 and a chute wall 117 extending from board 112. Dirt or soil collected on the board 112 during the process of forming a hole may be directed off of board 112 by tilting the board so that the dirt and soil is directed through chute 114 and out of chute outlet 119. With this design, the cleanup tool 110 may have only one board and only one plate.

Figure 11:
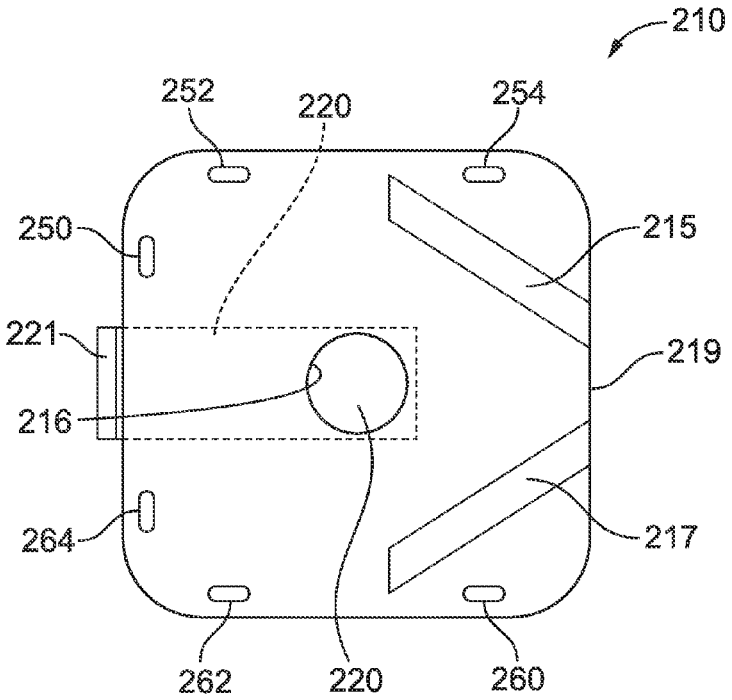
FIG. 11 is a top view of cleanup device 210 having a chute positioned on a top surface thereof.

FIG. 11 is a top view of cleanup tool 210. Cleanup tool 210 is similar to the cleanup tool 10 shown in FIGS. 1-9 with aperture 216 the same as aperture 16, and a plate 220 that is movable from a first closed position as shown in FIG. 11 to a second open position where the aperture 216 is open. Cleanup tool 210 includes a board having aperture 116 extending threrethrough and holes 250, 252, 254, 260, 262, and 264 that may serve as handholds for manipulating and transporting cleanup tool 210.

Cleanup tool 210 has a chute positioned on top. The chute is formed of a first chute wall 215 and a second chute wall 217 that extend towards chute outlet 219. Dirt or soil collected on cleanup tool 210 during the process of forming a hole may be directed off by tilting the cleanup tool 210 so that the dirt and soil is directed through chute outlet 219. Similar to FIG. 10, with this design, the cleanup tool 210 may have only one board and only one plate. However, cleanup tool 210 does not include a chute extension.

The cleanup tools and their components shown in FIGS. 1-11 may be made of a variety of different materials. For example, the boards, plates, supports, etc. may be made of wood, plastic, or composite materials, or even lightweight metals such as aluminum or magnesium, or a combination of those materials could be used.

It will be appreciated that the use of the cleanup tools shown in FIGS. 1-11 may advantageously reduce the amount of dirt and soil that needs to be cleaned up from the ground after the posts are positioned. As a result, the amount of cleanup time and the labor and expense of cleaning up the dirt and soil displaced during the hole forming process is advantageously reduced.

A method of forming holes for fence or deck posts using the cleanup tool shown in FIGS. 1-11 may be used to that reduces cleanup time and reduces the labor and expense of cleaning up the dirt and soil displaced during the hole forming process is provided. The method may include the steps of positioning a board having a top surface and a bottom surface over an area where a hole is to be formed in the earth, positioning an aperture located on the board over a spot where the hole is to be formed, positioning a plate slidably attached to the board into a first, open position where the aperture is open, forming a hole in the spot, collecting dirt or soil removed when forming the hole on the top surface of the board, moving the plate to a second, closed position, where the aperture is closed, transporting the board to a place where the dirt or soil may be directed off of the board, and tilting the board to direct dirt or soil that was collected on the board off of the board.

The method may further include the step of moving the top surface of the board towards a top surface of a second board to form a V-shaped surface before the step of tilting the board to direct dirt or soil off the board.

Example embodiments have been described above. Those skilled in the art will understand that changes and modifications may be made to the described embodiments without departing from the true scope and spirit of the present invention, which is defined by the claims.

We claim:

1. A device for the cleanup of dirt or soil removed when forming a hole in the earth, comprising:

a first board having a first edge;

a second board having a first edge;

a first hinge attached to the first edge of the first board and the first edge of the second board;

an aperture defined by a portion of the first edge of the first board and a portion of the first edge of the second board;

a first plate slidably attached to the first board;

wherein the first plate is movable from a first, open position where the aperture is open, to a second, closed position where the first plate extends over at least a portion of the aperture; and wherein a top surface of the first board is movable towards a top surface of the second board to form a V-shaped surface for directing dirt or soil off of the first board and the second board.

2. The device of claim 1, further comprising:

A second plate slidably attached to the second board;

wherein when the second plate is movable from a first, open position where the aperture is open, to a second, closed position where the second plate extends over at least a portion of the aperture; and wherein when the first plate is in the second, closed position and the second plate is in the second, closed position, the aperture is substantially closed.

3. The device of claim 2, wherein the end of the first plate contacts the end of the second plate such that the aperture is substantially closed.

4. The device of claim 2, wherein when the first plate is in the second, closed position and the second plate is in the second, closed position, an end of the first plate extends past an end of the second plate such that the aperture is substantially closed.

5. The device of claim 2, wherein the first plate is positioned on a bottom side of the first board.

6. The device of claim 5, wherein the second plate is positioned on a bottom side of the second board.

7. The device of claim 1, wherein the first hinge is positioned on a first side of the aperture, and a second hinge is positioned on a second side of the aperture that is opposite the first side of the aperture.

8. The device of claim 1, wherein the first board and the second board comprise plastic.

9. The device of claim 1, wherein the first plate has a flexible end, such that the aperture remains in a closed position when the first and second boards form the V-shaped surface.

10. The device of claim 1, wherein one or more holes are located on a periphery of the first board to provide one or more handholds on the first board, and one or more holes are located on a periphery of the second board to provide one or more handholds on the second board.

11. The device of claim 1, wherein the aperture has a diameter that is sized to accommodate an 8-inch auger positioned through the aperture when a hole is being drilled by the auger.

12. The device of claim 1, wherein the first plate is moveable in a linear direction with respect to the first board.

13. The device of claim 1, wherein the first plate is movable from the first, open position to the second, closed position by slidable rotation of the first plate with respect to the first board.

14. The device of claim 2, wherein the top surface of the first board is movable into contact with the top surface of the second board to provide a folded device for improved carrying and storage of the device.

15. A device for the cleanup of dirt or soil removed when forming a hole in the earth, comprising:

a board having a top surface and a bottom surface;

an aperture positioned through the board;

a plate slidably attached to the board;

wherein the plate is movable from a first, open position where the aperture is open, to a second, closed position where the plate extends over the aperture; and wherein the aperture has a diameter that is sized to accommodate an 8-inch auger positioned through the aperture when a hole is being drilled by the auger.

16. The device of claim 15, wherein a chute extends from a side of the board for directing dirt or soil off of the board through a chute outlet.

17. The device of claim 15, wherein a first chute wall is positioned on the top surface of the board and a second chute wall is positioned on the top surface of the board, the first and second chute walls providing a chute for directing dirt or soil off of the board through a chute outlet.

18. A method of removing dirt or soil from a hole in the earth, comprising:

positioning a board having a top surface and a bottom surface over an area where a hole is to be formed in the earth;

positioning an aperture located on the board over a spot where the hole is to be formed;

positioning a plate slidably attached to the board into a first, open position where the aperture is open;

forming a hole in the spot;

collecting dirt or soil removed when forming the hole on the top surface of the board;

moving the plate to a second, closed position, where the aperture is closed;

transporting the board to a place where the dirt or soil may be directed off of the board;

and tilting the board to direct dirt or soil that was collected on the board off of the board.

19. The method of claim 18, wherein a first end of the board is attached to a hinge, and a second board is attached to the hinge;

wherein a second plate is slidably attached to the second board;

wherein the second plate is movable from a first, open position where the aperture is open, to a second, closed position where the second plate extends over at least a portion of the aperture; and wherein when the first plate is in the second, closed position and the second plate is in the second, closed position, the aperture is substantially closed.

20. The method of claim 18, further including the step of moving the top surface of the board towards a top surface of the second board to form a V-shaped surface before the step of tilting the board to direct dirt or soil off the board.

* * * * *